US005653311A

United States Patent [19]

Heikkinen et al.

[11] Patent Number: 5,653,311

[45] Date of Patent: Aug. 5, 1997

[54] SUSPENSION ARRANGEMENT FOR A HYDRAULIC ELEVATOR

[75] Inventors: Urho Heikkinen, Espoo; Raimo Pelto-Huikko, Vantaa, both of Finland

[73] Assignee: Kone Oy, Helsinki, Finland

[21] Appl. No.: 471,383

[22] Filed: Jun. 6, 1995

[30] Foreign Application Priority Data

Jun. 14, 1994 [FI] Finland ..... 942820

[51] Int. Cl.[6] ..... B66B 11/04

[52] U.S. Cl. ..... 187/253; 187/272

[58] Field of Search ..... 187/404, 253, 187/252, 272; 254/271, 264

[56] References Cited

U.S. PATENT DOCUMENTS

| | | | |
|---|---|---|---|
| 2,627,943 | 2/1953 | Hastings, Jr. | 187/253 |
| 4,333,549 | 6/1982 | Davis | 187/93 |
| 4,830,146 | 5/1989 | Nakamura et al. | 187/26 |

FOREIGN PATENT DOCUMENTS

| | | | |
|---|---|---|---|
| 1531106 | 8/1969 | Germany . | |
| 4034564 | 4/1992 | Germany | 187/253 |
| 2-261790 | 10/1990 | Japan . | |
| 3008686 | 1/1991 | Japan | 187/253 |
| 1438727 | 6/1976 | United Kingdom . | |

*Primary Examiner*—Kenneth Noland

*Attorney, Agent, or Firm*—Birch Stewart Kolasch & Birch, LLP

[57] ABSTRACT

The invention relates to a suspension arrangement for a hydraulic elevator. In addition to a normal diverting pulley mounted on the top end of the piston of the hoisting cylinder, the arrangement includes an additional diverting pulley placed at the bottom end of the cylinder. The first ends of the elevator ropes are fixed to a rope anchorage in the car frame of the elevator, from where the ropes are passed over the diverting pulley on the top end of the piston to the additional diverting pulley, from which additional diverting pulley the ropes are further passed to an adapter moving with the top end of the piston, with the second ends of the ropes being attached to the adapter.

8 Claims, 3 Drawing Sheets

SUSPENSION ARRANGEMENT FOR A HYDRAULIC ELEVATOR

BACKGROUND OF THE INVENTION

1. Field of the Invention

The present invention relates to a suspension arrangement for a hydraulic elevator.

2. Description of the Background Art

At present, conventional hydraulic elevators are implemented as rucksack-type elevators in which the elevator car is mounted on a supporting frame resembling a rucksack. As to their suspension, these elevators are either of a direct-acting or an indirect-acting type. Direct-acting elevators of normal construction without an expensive telescopic cylinder are only applicable in low-rise buildings where the elevator only serves one or two floors. Therefore, most hydraulic elevators employ an indirect-acting type of suspension. Such elevators usually have a hoisting height of 3.5–15 m, corresponding to 2–6 floors. The maximum hoisting height is about 20 m. In an indirect-acting elevator, a hoisting rope attached to a fixed column is passed over a diverting pulley mounted on top of the piston and further to the car frame supporting the elevator car. Due to this roping, the car travel equals twice the stroke of the piston, which is why this type of suspension is termed 2:1 suspension.

However, this widely used suspension system has certain serious drawbacks. First, since the length of the cylinder (and the piston inside it) equals at least half the entire hoisting height, difficulties are encountered in transporting such a long cylinder into the elevator shaft. The cylinder is usually brought into the shaft via its door opening, in which case the cylinder may be at most about as long as the guide rail bar, i.e. about 5 m. This limits the hoisting height to 10 m, corresponding to four floors.

When larger hoisting heights are to be achieved, the cylinder has to be hoisted into the shaft via the top of the shaft. However, this is only possible at an early stage of the construction work, and it is necessary to schedule the transport and hoisting of the cylinder into the shaft accordingly. This causes extra work and expenses. Moreover, the cylinder has to be protected in the shaft during construction, and it is always more or less of a hindrance to other work.

Another solution applied in the case of large hoisting heights is to use an extendable cylinder. In this case, the cylinder is composed of two sections which are only joined together in the shaft. However, because of the threaded joint, the cylinder has to be manufactured from a thicker tube than a jointless one. Because of the joint, the manufacture of the cylinder and especially its final grinding is an elevator- and cylinder-specific and expensive job. The testing of the cylinder also requires special arrangements, and joining the cylinder sections and installing the cylinder in a narrow and dirty space is difficult and expensive. A jointed cylinder costs at least one and a half times as much as a jointless one.

Another limitation in the case of 2:1 suspension, in addition to the problem of moving the cylinder into the shaft, is the risk of buckling of the piston tube at larger hoisting heights. This limits the hoisting height and makes it necessary to increase the thickness of the wall of the piston tube. However, this increases the weight of the piston, thus reducing the usable hoisting capacity of the cylinder. Moreover, due to the material costs, this is an expensive solution. Another way to solve the buckling problem is to use reinforcements to prevent buckling, but this also involves additional costs.

SUMMARY OF THE INVENTION

The object of the present invention is to achieve a suspension arrangement for a hydraulic elevator that allows quick and simple installation of the hydraulic elevator and permits advanatageous use of large hoisting heights. In addition, the above-mentioned drawbacks of known solutions are eliminated.

The invention provides the advantage that, using a cylinder length (about 5 m) that is optimal in view of transport and handling of the cylinder, hoisting heights one and half times or even twice as large as in the case of the present 2:1 suspension, i.e. a height of about 15–22 m, can be achieved. This means that the range of application of the hydraulic elevator can be substantially enlarged to cover larger hoisting heights without expensive and sensitive jointed cylinders. A further advantage is that, because a short cylinder is used, buckling of the piston is no longer a decisive factor in the dimensioning, but the piston is always dimensioned according to the pressure. This means that, for each piston size, only one piston tube wall thickness is required, thus reducing the number of different cylinder assemblies needed. This involves an essential advantage in respect of manufacturing technology and logistics. The suspension arrangement of the invention makes it possible to use a cylinder system in which the maximum cylinder length is only 5.5 m and the cylinder is mounted directly on an elevator guide rail, permitting serial production of cylinders for different lengths, e.g. at 0.25 m intervals. At present, the cylinders have to be manufactured specifically for each elevator for different lengths from 3 m to 11 m, with possible extensions. For this reason, current arrangements involve difficult problems for the rationalization of manufacture and the delivery process as a whole. The whole extended hoisting height range of the hydraulic elevator can now be optimally implemented using the following system.

| | | |
|---|---|---|
| Hoisting height | $H \leqq 3.5$ m | suspension 1:1 |
| | $H \leqq 11$ m | suspension 2:1 (present) |
| | $H \leqq 16.5$ m | suspension 3:1 |
| | $H \leqq 22$ m | suspension 4:1 |

Yet another advantage is that, as the weight of the piston tube is minimized due to the reduced wall thickness and tube length, a larger useful load of the elevator can be achieved than in previously known solutions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
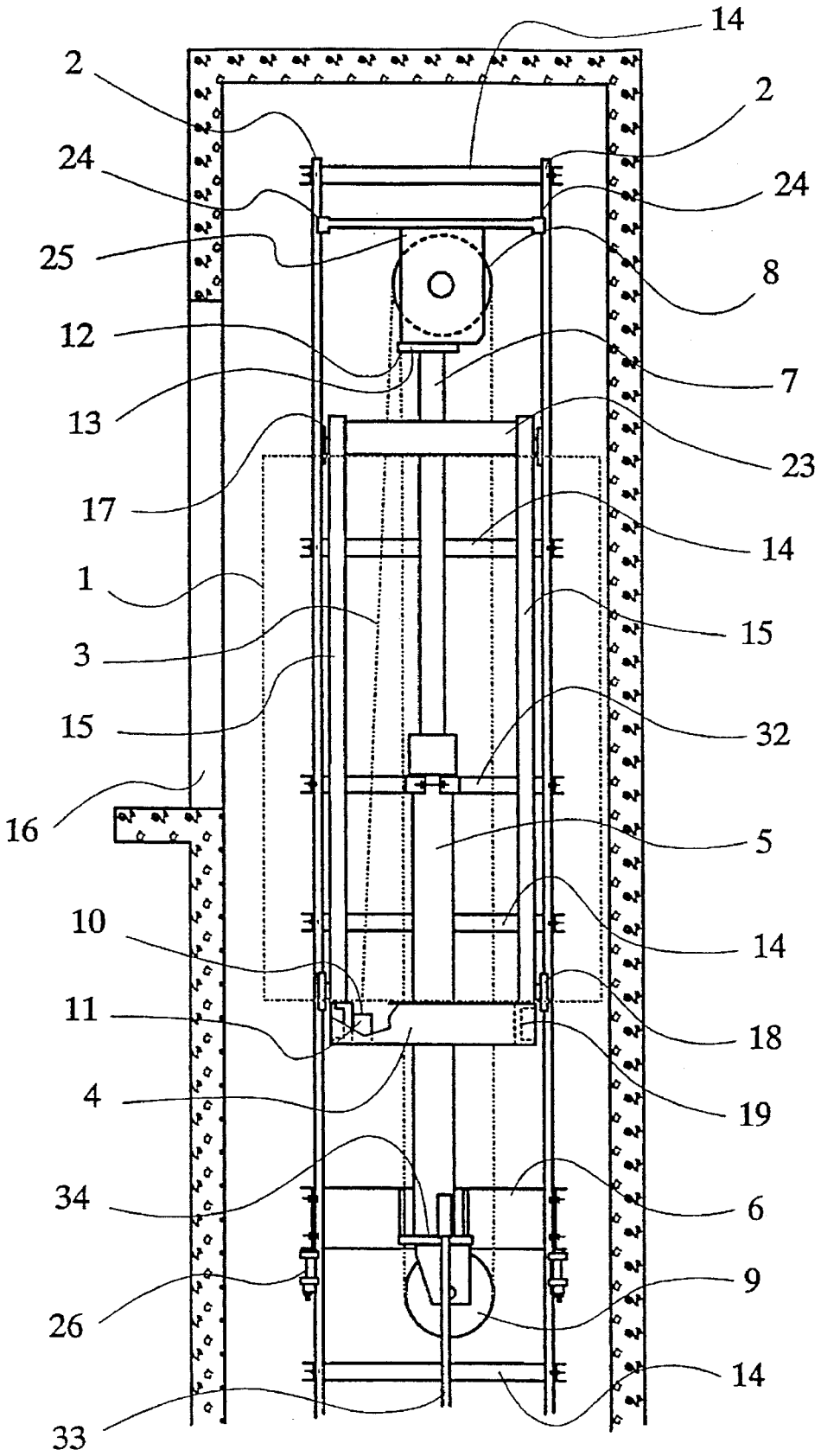
FIG. 1 is a 3:1 suspension arrangement in the upper part of the elevator shaft in side view.
Figure 2:
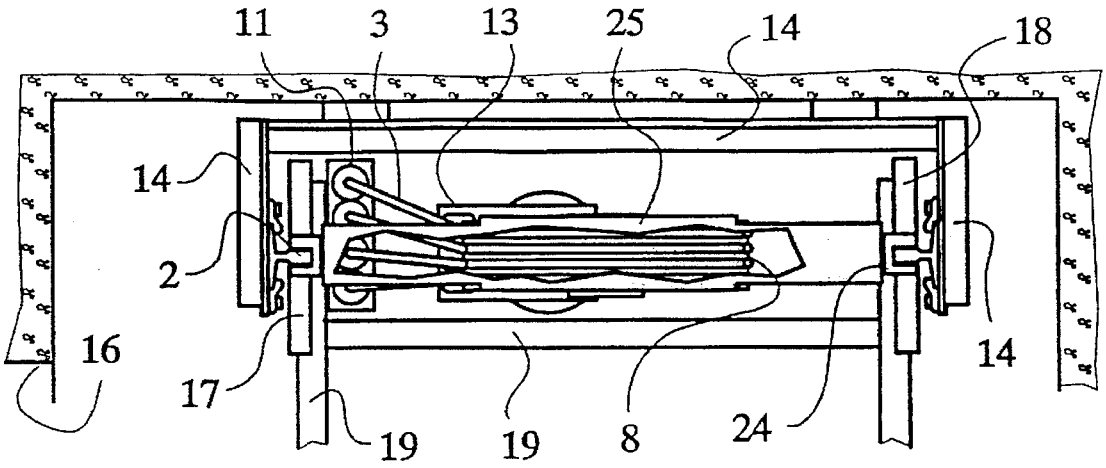
FIG. 2 is the same suspension arrangement in top view and in a simplified form.
Figure 6:
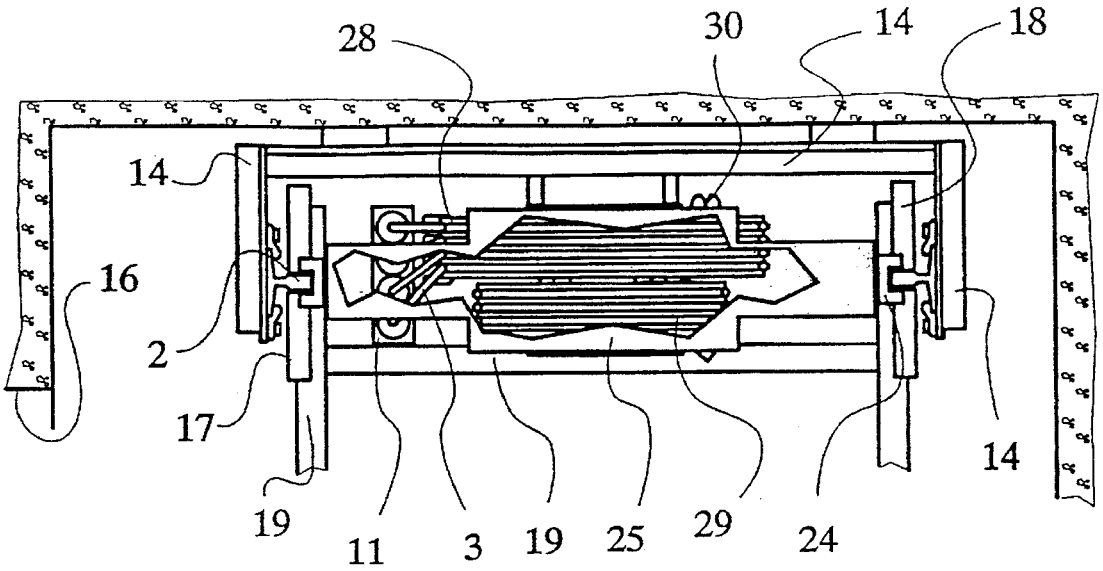
FIG. 6 is a 4:1 suspension arrangement as provided by the invention, in simplified form and seen from above.
Figure 7:
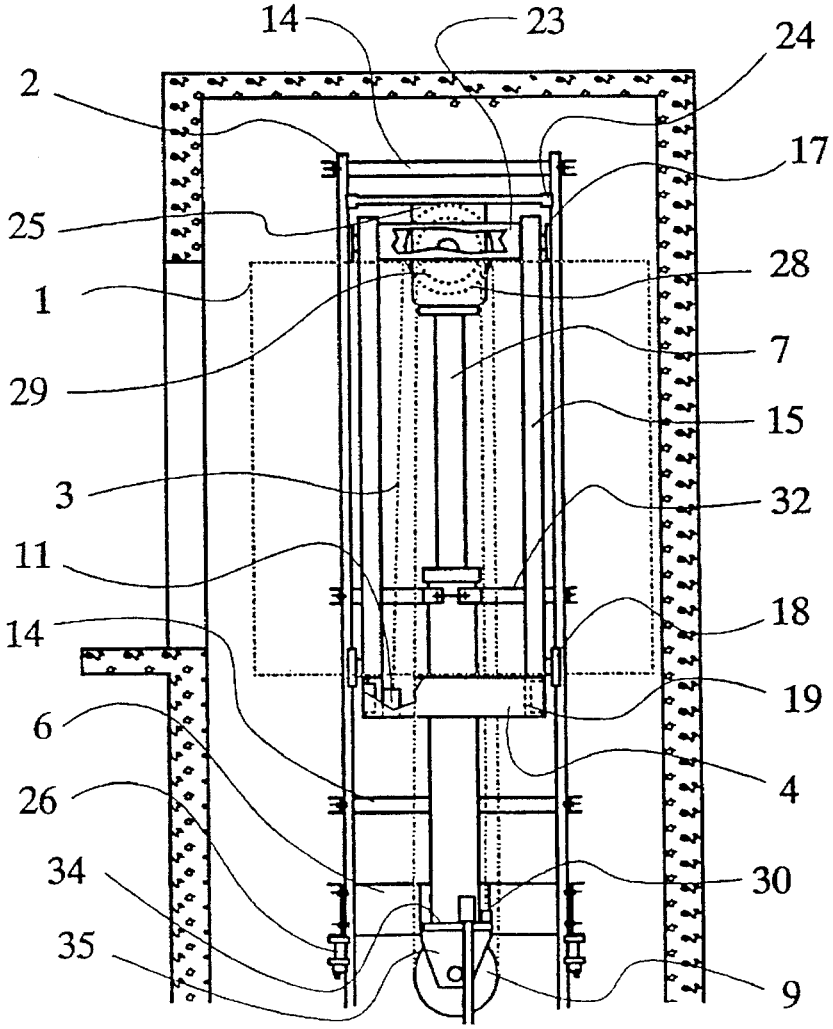
FIG. 7 is the same suspension arrangement shown in FIG. 6 as seen from side of the elevator.

FIG. 1 shows the upper end of an elevator shaft in lateral view. Of the elevator and shaft equipment, only the essential, most important elements with regard to the invention are shown. The elevator car 1 together with the car frame 4,15,19,23 moves along vertical guide rails 2 which are fixed to the bottom of the shaft. In addition, the guide rails are secured to a shaft wall by means of rail fixing brackets 14 placed at certain distances from each other. The suspension of the elevator car is of the so-called rucksack type, which in this context means that the elevator car is not directly supported by the guide rails 2 but instead by a car frame moving along the guide rails and comprising a bottom beam 4 placed near the first side wall of the elevator shaft (in FIGS. 2 and 6, the removed wall on the side facing towards the viewer, and in FIGS. 6 and 7 the removed wall at the lower end) and essentially horizontal supporting beams 19 attached by their first ends to the ends of said bottom beam 4 and directed from the bottom beam towards the second side wall of the elevator shaft. The distance between the supporting beams 19 is suitably shorter than the distance between the guide rails 2. The other ends of the supporting beams are attached to the lower ends of essentially upright vertical beams 15 extending upwards to a height suitably exceeding the height of the elevator car. The upper ends of the vertical beams are connected to each other by an overhead beam 23 placed essentially above the elevator car, the elevator car being fixed by its upper part to the overhead beam 23. As seen from the direction of the door opening 16, the vertical beam 15 and the supporting beam 19 in the arrangement illustrated by the figure form a car supporter having the shape of letter L facing left, the elevator car being mounted on the supporting beams 19. The car frame is supported on the guide rails by means of guide rollers 18 running on the guide surface facing towards the elevator car. Correspondingly, at the upper end of the car frame there are guide rollers 17 running along the opposite guide surface as compared to the lower guide rollers. This arrangement prevents the car frame from overturning sideways from the guide rail.

At its lower end, the hydraulic cylinder 5 is immovably mounted directly on the elevator guide rails 2 by means of a cylinder supporter 6 provided with a projecting base 34 carrying the cylinder. This solution obviates the need to use a separate supporting pillar, which, normally extending from the lower end of the hydraulic cylinder to the bottom of the shaft, would be very long and expensive. Like the rail fixing brackets 14, the cylinder supporter 6 is attached to the guide rails by means of rail clips and bolts. The cylinder force is transmitted by the guide rails to the bottom of the shaft.

Figure 3:
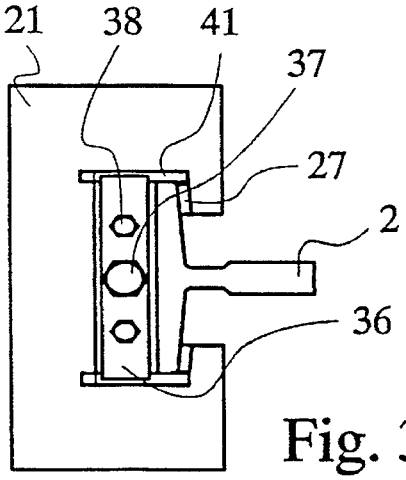
FIG. 3 is a cylinder holding device as seen from one end of the guide rail.
Figure 5:
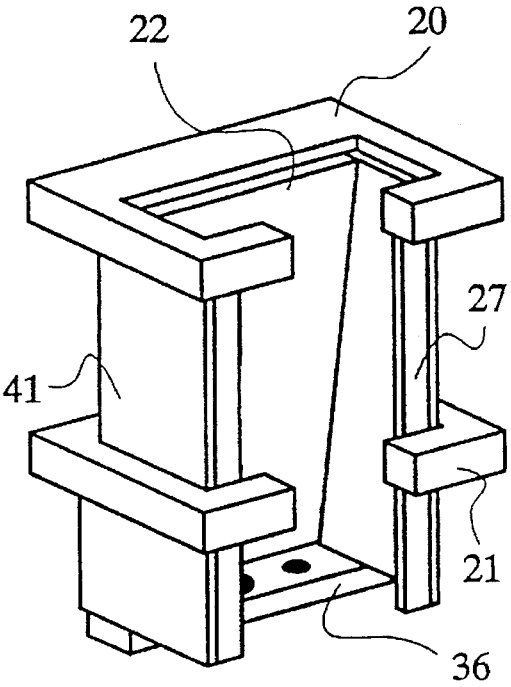
FIG. 5 is the frame of a cylinder holding device in oblique top view.
Figure 4:
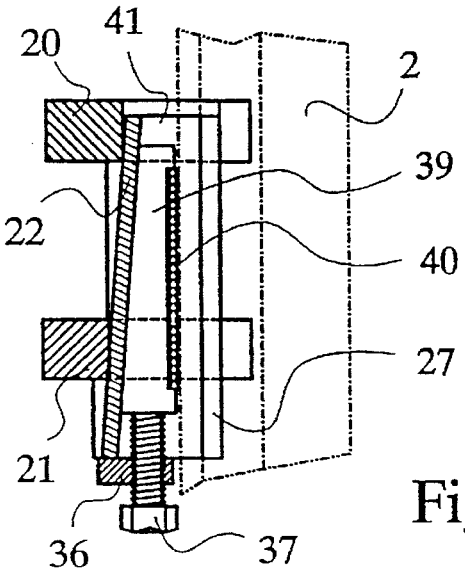
FIG. 4 is a cylinder holding device as seen from one side of the guide rail.

To support the cylinder supporter vertically on the guide rails, a holding device 26 as illustrated by FIGS. 3, 4 and 5 is used. The frame of the holding device, which consists of a hollow wedge-shaped socket 22, 27, 41 tapering upwards, reinforcements 20, 21 bracing the socket and a supporting bar 36 at the lower end of the socket, is placed around the back of the guide rail so as to leave a free space for the elevator between the guide rails. The frame and the reinorcements 21, 21 are open on the side facing towards the guide rail, so that, as the back of the guide rail is inside the frame of the holding device, the guiding part of the rail remains outside. As seen from above, the frame has essentially the shape of a rectangular letter C in which the inclined back wall 22 is perpendicular to each of the straight side walls 41 at the edges. Starting at the front edge of each side wall there is a narrow front wall 27 in a position slightly turned out, the two front walls being essentially directed towards each other. Thus, the front walls are not exactly perpendicular to the side walls, but the slant of the front walls corresponds to the slant of the back of the guide rail. Between the front walls there remains the above-mentioned opening of the C-shaped frame, said opening extending through the whole height of the frame, through which opening the guiding part of the guide rail protrudes from inside the frame of the holding device.

The supporting bar 36 at the bottom of the holding device, which connects the two side walls, is provided at its middle with a threaded hole for a tightening screw 37. Moreover, on each side of the threaded hole there is one unthreaded hole for screws 38 for releasing the wedge 39. The wedge 39 placed inside the frame of the holding device is correspondingly provided with threaded holes for the release screws. The wedge 39 itself is a body of a width nearly equal to the width of the space inside the frame, tapering upwards in its lateral dimension. The wedge is mounted between the slanting back wall 22 of the frame and the rear surface of the back of the guide rail. The straight front surface of the wedge, which is pressed against the rear surface of the back of the guide rail, is provided with two parallel cutouts, each of which accommodates a serrated arrester 40 whose serrations are pressed against the rear surface of the back of the guide rail when the wedge is tightened in place by means of the tightening screw 37.

One holding device 26 is provided for each guide rail. After the holding devices have been tightened on the guide rails, the cylinder supporter 6 can be lowered onto the holding devices. The cylinder itself is fixed with screws onto the projecting base 34 of the cylinder supporter. When the cylinder, supporter and holding devices are to be raised e.g. during installation or repair work, the wedge is released from its tightened condition by means of the release screws 38. This solution makes it easy to mount the cylinder steplessly at the correct height in the elevator shaft and obviates the need for a separate supporting pillar as mentioned above.

At the lower end of the cylinder there is a diverting pulley 9 which is rotatably mounted on lugs 35 and is immovable in horizontal and vertical directions. At its upper end the cylinder is secured by means of a band 32 or equivalent which in turn is fastened to the guide rails in the same way as the rail fixing brackets 14.

Inside the cylinder is a piston 7, which is provided with a diverting pulley unit mounted on the upper end of the piston, comprising a frame 25 and sliding guides 24 mounted on its upper part, one for each guide rail 2. Mounted on the lower part of the frame is a horizontally adjustable adapter 13, to which the other ends 12 of the parallel elevator ropes 3 are fastened. The adapter allows the ropes to be so attached to cylinders of different sizes that the effect of the rope force can easily be centered in relation to the piston. Moreover, there is a diverting pulley 8 rotatably mounted on the frame. As the piston moves vertically, the guides 24 slide along the rails 2, keeping the upper end of the piston horizontally steady.

The first ends of the elevator ropes 3 are attached to a rope anchorage 11 in the car frame, from where they are passed via the diverting pulley 8 mounted on the piston 7 and around the additional diverting pulley 9 at the lower end of the cylinder and further up to the adapter 13 attached to the diverting pulley unit on the piston. It follows from this suspension that when the piston moves through a distance of one unit of measure, the elevator car moves through a distance of three units of measure, so this suspension can be termed 3:1 suspension.

A feature essential to the solution of the invention is that the positions of the diverting pulley 8 on the top end of the piston and the point of rope attachment on the adapter 13 relative to each other are so selected that the resultant of the forces transmitted through them to the piston end is applied to the end of the piston 7 completely centrically without generating a bending moment. Therefore, the diverting pulley 8 lies horizontally eccentrically on the piston 7 and the rope attachment point on the adapter 13 lies horizontally on the opposite side of the midline of the piston 7 in relation to the midline of the diverting pulley 8. It is also important that the additional diverting pulley 9 at the bottom end of the cylinder has a smaller diameter than the diverting pulley 8 on top of the piston. Moreover, the additional diverting pulley 9 at the lower end is horizontally eccentrically placed in relation to the midline of the cylinder. For both diverting pulleys, the direction of eccentricity is the same. The position of the rope anchorage 11 on the car frame is so chosen that the anchorage lies at a sufficient horizontal distance from the ropes running from the additional diverting pulley 9 to the point of rope attachment on the adapter 13. This distance is sufficient if, when the elevator is moving, the rope anchorage 11 passes the additional diverting pulley 9 at a distance considered sufficient. Because of this passing, it is essential that the additional diverting pulley 9 at the lower end should have a smaller diameter than the diverting pulley 8 on the top end and that it should be eccentrically mounted, as mentioned above.

It is obvious to a person skilled in the art that different embodiments of the invention are not restricted to the example described above, but that they may instead be varied within the scope of the claims presented below. Thus, for example, in view of larger hoisting heights, instead of using a suspension ratio as presented above, the suspension ratio could be 4:1, which is the case in the elevators illustrated by FIGS. 6 and 7. In this case, the passage and points of attachment of the elevator ropes differ from 3:1 suspension. In addition, instead of one diverting pulley, the top end of the piston is provided with two diverting pulleys placed side by side. As in the case of 3:1 suspension, the first ends of the ropes are attached to a rope anchorage 11 in the car frame, from where the ropes are passed via a first diverting pulley 28 mounted on the top end of the piston and around an additional diverting pulley 9 at the lower end of the cylinder 5 and further up to a second diverting pulley 29 at the top end of the piston and then down to an anchorage 30 on the mounting of the lower end of the cylinder. In this suspension, all diverting pulleys 9, 28 and 29 are centrically placed in relation to the midline of the cylinder 5 and piston 7. Moreover, the second diverting pulley 29 on the top end has a smaller diameter than the first diverting pulley 28 on the top end.

4:1 suspension provides the same advantages as 3:1 suspension and a 5-m cylinder length allows a hoisting height of 22 m to be achieved, which is sufficient to cover the entire range of elevators at present implemented e.g. as so-called side-drive rope-driven elevators with machine room below. At present, this elevator type competes directly with the hydraulic elevator.

When 4:1 or 3:1 suspension is used, naturally a larger cylinder force is required and consequently the cylinder size is increased. However, this is not a disadvantage because, as explained above, the invention provides the advantage of short cylinders free of the risk of buckling and thus a reduced number of different cylinder sizes, which brings more savings than the increased cylinder size increases the costs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A suspension arrangement for a hydraulic elevator, said elevator including an elevator car, a car frame supporting the elevator car, substantially vertical guide rails along which the car frame travels, moved by means of at least one elevator rope, a first end of the elevator rope being fixed to a rope anchorage on the car frame, and a hydraulic cylinder and a piston with a diverting pulley on its top end for the elevator rope, the arrangement comprising:

at least one additional diverting pulley around which the elevator rope coming from the diverting pulley on the top end of the piston is passed to its point of attachment, wherein the elevator rope has been directed from the rope anchorage first over the diverting pulley on the top end of the piston.

2. The suspension arrangement as defined in claim 1, wherein the elevator rope has been directed from the additional diverting pulley placed at the bottom end of the hydraulic cylinder to an adapter moving with the top end of the piston, the other end of the rope being attached to said adapter.

3. The suspension arrangement as defined in claim 2, wherein the position of the point, of attachment of the other end of the elevator rope on the adapter and the horizontal position of the diverting pulley on the top end of the piston in relation to the midline of the piston are so selected that the force applied to the piston by the elevator rope is as centric as possible.

4. The suspension arrangement as defined in claim 1, wherein the diameter of the additional diverting pulley at the lower end of the cylinder is smaller than the diameter of the diverting pulley at the top end of the piston, and wherein the horizontal positions of the additional diverting pulley, the anchorage of the first end of the rope and the adapter relative to each other are so chosen that the anchorage can pass the additional diverting pulley with a sufficient clearance when the elevator car is moving.

5. The suspension arrangement as defined in claim 1, wherein the additional diverting pulley is located at the bottom end of the hydraulic cylinder, from which additional diverting pulley the rope is further passed around a second diverting pulley on the top end of the piston to a fixed point to which the other end of the rope is attached.

6. A suspension arrangement for a hydraulic elevator, said elevator including an elevator car, a car frame supporting the elevator car, substantially vertical guide rails along which the car frame travels, and at least one elevator cable attached at a first end to an anchorage on the car frame, said suspension arrangement comprising:

a hydraulic cylinder having a piston therein;

a first diverting pulley located on an upper end of the piston for the elevator cable to pass over;

a second diverting pulley located on a lower end of the cylinder around which the elevator cable coming from the first diverting pulley on the upper end of the piston is passed; and an adapter located at said upper end of said piston for attachment of the second end of the elevator cable, wherein the position of the point of attachment of the second end of the elevator cable on the adapter, and the horizontal position of the first diverting pulley on the upper end of the piston in relation to a midline of the piston, are so selected that the force applied to the piston by the elevator cable is as centric as possible.

7. A suspension arrangement for a hydraulic elevator, said elevator including an elevator car, a car frame supporting the elevator car, substantially vertical guide rails along which the car frame travels, and at least one elevator cable attached at a first end to an anchorage on the car frame, said suspension arrangement comprising:

a hydraulic cylinder having a piston therein;

a first diverting pulley located on an upper end of the piston for the elevator cable to pass over;

a second diverting pulley located on a lower end of the cylinder around which the elevator cable coming from the first diverting pulley on the upper end of the piston is passed; and an adapter located at said upper end of said piston for attachment of the second end of the elevator cable, wherein the diameter of the second diverting pulley at the lower end of the cylinder is smaller than the diameter of the first diverting pulley at the upper end of the piston, and wherein the horizontal positions of the second diverting pulley, the anchorage, and the adapter relative to each other are so chosen that the anchorage can pass the second diverting pulley with a sufficient clearance when the elevator car is moving.

8. An arrangement for mounting a hydraulic cylinder to the back of at least one guide rail of an elevator, the arrangement comprising:

a cylinder support attachable to the guide rail for receiving a lower end of the hydraulic cylinder; and at least one holding device attachable to the guide rail for supporting the cylinder support on the guide rail, wherein the holding device has a hollow wedge-shaped socket which is placed around a back portion of the guide rail, and an upwardly tapering tightening wedge located within the socket, said wedge being tightenable between the socket and a rear surface of the back portion of the guide rail.

* * * * *